US009644281B2

(12) United States Patent
Tatebe et al.

(10) Patent No.: US 9,644,281 B2
(45) Date of Patent: May 9, 2017

(54) COSMETIC AND PROTECTIVE METAL SURFACE TREATMENTS

(71) Applicant: Apple Inc., Cupertino, CA (US)

(72) Inventors: Masashige Tatebe, Tokyo (JP); Takahiro Oshima, Tokyo (JP)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 14/044,639

(22) Filed: Oct. 2, 2013

(65) Prior Publication Data

US 2014/0166490 A1 Jun. 19, 2014

Related U.S. Application Data

(60) Provisional application No. 61/739,610, filed on Dec. 19, 2012.

(51) Int. Cl.

| | |
|---|---|
| ***C25D 5/02*** | (2006.01) |
| ***C25D 11/16*** | (2006.01) |
| ***C25D 11/18*** | (2006.01) |
| ***C25D 11/22*** | (2006.01) |
| ***C25D 11/26*** | (2006.01) |
| ***C25D 11/30*** | (2006.01) |
| ***C25D 11/34*** | (2006.01) |
| ***C25D 11/24*** | (2006.01) |

(52) U.S. Cl.

CPC ..... *C25D 5/02* (2013.01); *C25D 11/16* (2013.01); *C25D 11/18* (2013.01); *C25D 11/22* (2013.01); *C25D 11/243* (2013.01); *C25D 11/26* (2013.01); *C25D 11/30* (2013.01); *C25D 11/34* (2013.01)

(58) Field of Classification Search

CPC ..... C23C 28/345; C25D 11/22

USPC ..... 205/50, 199

See application file for complete search history.

(56) References Cited

U.S. PATENT DOCUMENTS

| | | | | |
|---|---|---|---|---|
| 4,994,314 A | * | 2/1991 | Rosenfeld et al. | 428/36.92 |
| 5,132,003 A | | 7/1992 | Mitani | |
| 5,167,793 A | | 12/1992 | Jozefowicz | |

(Continued)

FOREIGN PATENT DOCUMENTS

| | | | | |
|---|---|---|---|---|
| GB | 953344 | * | 6/1960 | |
| JP | 52022534 | * | 2/1977 | C25D 11/34 |

(Continued)

OTHER PUBLICATIONS

Zhu, H., et al., "Etching effects and the formation of streaking defects on Al Extrusions", 2011, Aluminum International Today.*

(Continued)

*Primary Examiner* — Stefanie S Wittenberg

(74) *Attorney, Agent, or Firm* — Downey Brand LLP

(57) ABSTRACT

An article having a metal surface is treated to have one or more desired optical effects. The surface is anodized to create an anodic film having pores therein. In some embodiments, an electrodeposition process is performed to deposit one or more metals within the pores of the anodic film. In some embodiments, a pre-dip procedure is performed prior to electrodeposition to create a more uniformly colored anodic film. In some embodiments, one or more dyes are deposited within the pores of the anodic film. In some embodiments, the substrate is exposed to a chemical etching process prior to anodizing to create a micro-textured surface that enhances the richness of the color of the anodic film.

19 Claims, 11 Drawing Sheets

(56) References Cited

U.S. PATENT DOCUMENTS

| | | | | |
|---|---|---|---|---|
| 5,218,472 | A | 6/1993 | Jozefowicz | |
| 5,277,982 | A | 1/1994 | Jozefowicz | |
| 6,379,523 | B1 | 4/2002 | Takabayashi | |
| 2005/0045487 | A1* | 3/2005 | Kia et al. | 205/224 |
| 2008/0274375 | A1* | 11/2008 | Ng et al. | 428/687 |
| 2011/0056836 | A1 | 3/2011 | Tatebe et al. | |
| 2011/0165391 | A1 | 7/2011 | Yamaguchi | |
| 2011/0214993 | A1 | 9/2011 | Akana et al. | |
| 2011/0284381 | A1 | 11/2011 | Cabot et al. | |
| 2012/0145552 | A1* | 6/2012 | Nagai et al. | 205/131 |
| 2012/0155228 | A1* | 6/2012 | Murazumi | C22F 1/183 368/280 |
| 2013/0153427 | A1 | 6/2013 | Tatebe | |

FOREIGN PATENT DOCUMENTS

| | | | | |
|---|---|---|---|---|
| JP | 63-243294 | * | 10/1988 | C25D 3/12 |
| JP | 07-316883 | | 12/1995 | |
| JP | 2006213947 | * | 8/2006 | C25D 11/04 |
| WO | WO0118281 | | 3/2001 | |

OTHER PUBLICATIONS

Chandia, M.U.F., et al., "Effect of Composition, Grain Size and Texture on the Etching Response of 6xxx Alloys", Proceedings of the 12th International Conference on Aluminum Alloys, Sep. 2010, Yokohama, Japan.*

PCT/US2013/068758. Int'l Search Report & Written Opinion (Feb. 7, 2014).

* cited by examiner

COSMETIC AND PROTECTIVE METAL SURFACE TREATMENTS

CROSS-REFERENCE TO RELATED APPLICATIONS

This application claims the benefit of U.S. Provisional Patent Application No. 61/739,610, filed Dec. 19, 2012, and entitled "COSMETIC AND PROTECTIVE METAL SURFACE TREATMENTS", which is incorporated by reference in its entirety for all purposes.

FIELD OF THE DESCRIBED EMBODIMENTS

This disclosure relates generally to anodizing and anodic films for metal articles. More specifically, methods for producing anodic films having particular cosmetic qualities are disclosed.

BACKGROUND

Many commercial products have metal surfaces that are treated with one or more surface treatments to create a desired effect, either functional, cosmetic, or both. One example of such a surface treatment is anodizing. Anodizing a metal surface converts a portion of the metal surface into a metal oxide, thereby creating a metal oxide layer, sometimes referred to as an anodic film. Anodic films provide increased corrosion resistance and wear resistance. In addition, anodic films can be used to impart a desired cosmetic effect to the metal surface. For example, pores in the oxide layer formed during anodizing can be filled with dyes to impart a desired color to the surface.

The cosmetic effect of metal surface treatments can be of great importance. In consumer product industries, such as the electronics industry, visual aesthetics can be a deciding factor in a consumer's decision to purchase one product over another. Accordingly, there is a continuing need for new surface treatments or combinations of surface treatments for metal surfaces to create products with new and different visual appearances or cosmetic effects.

BRIEF SUMMARY

This paper described various embodiments that relate to providing anodic films that have particular cosmetic qualities. For example, the anodic films can be treated to have particular optical properties such certain colors or glossiness.

According to one embodiment, a method of providing a coating on a metal substrate is described. The method involves converting at least a portion of the metal substrate to an anodic film having a number of pores, each of the pores having a bottom portion proximate an un-converted portion of the metal substrate. The method also involves diffusing metal ions within at least a portion of the pores by exposing the anodic film to a solution having the metal ions dissolved therein. The method also involves causing at least a portion of the diffused metal ions to move toward the bottom portions of the pores. When the diffused metal ions contact surfaces within the bottom portions of the pores, the metal ions convert to metal, the metal causing the anodic film to take on a color. Diffusing the metal ions within the pores prior to causing the diffused metal ions to move toward the bottom portions of the pores is associated with a color uniformity of the anodic film.

According to another embodiment, a method of providing a coating on a surface of a metal substrate is described. The method involves exposing the surface to a chemical etch solution. The chemical etch solution preferentially erodes grain boundaries at the surface of the metal substrate such that the surface attains a micro-textured topology having a number of valleys at the grain boundaries and a number of peaks positioned between the valleys. An average pitch between the peaks is associated with the grain size at the surface of the metal substrate. The method also involves converting at least a portion of the metal substrate to an anodic film having a number of pores. During the converting, a boundary surface between the metal substrate and the anodic film is formed. The boundary surface has a micro-textured topology with an average pitch between peaks corresponding to the micro-textured topology of the metal substrate. The method further involves depositing a metal material within the pores. The deposited metal material absorbs a range of wavelengths of visible light incident a top surface of the anodic film and imparts a corresponding color to anodic film. An amount of absorbed light is associated with the average pitch between the peaks of the micro-textured boundary surface.

According to a further embodiment, a metal part is described. The metal part includes a metal substrate surface having a micro-textured topology having a plurality of peaks and valleys. The positions of the valleys substantially correspond to the grain boundaries of the metal substrate and the positions of the peaks are positioned between the valleys. An average pitch between the peaks is associated with the grain size of the metal substrate. The metal part also includes an anodic film disposed on the metal substrate surface. The anodic film has a number of pores, each of the pores having metal material deposited therein. The deposited metal material absorbs a range of wavelengths of visible light incident a top surface of the anodic film and imparts a corresponding color to anodic film. An amount of absorbed light is associated with the average pitch between the peaks of the micro-textured metal substrate.

BRIEF DESCRIPTION OF THE FIGURES

The described embodiments and the advantages thereof may best be understood by reference to the following description taken in conjunction with the accompanying drawings. These drawings in no way limit any changes in form and detail that may be made to the described embodiments by one skilled in the art without departing from the spirit and scope of the described embodiments.

DETAILED DESCRIPTION

Representative applications of methods and apparatuses according to the present application are described in this section. These examples are being provided solely to add context and aid in the understanding of the described embodiments. It will thus be apparent to one skilled in the art that the described embodiments may be practiced without some or all of these specific details. In other instances, well known process steps have not been described in detail in order to avoid unnecessarily obscuring the described embodiments. Other applications are possible, such that the following examples should not be taken as limiting This application relates to various embodiments of methods for providing cosmetically appealing anodic films. Methods include treating anodic films to have particular optical properties such as particular colors, glossiness, or matte appearance. The cosmetically appealing anodic films are well suited for providing protective and attractive surfaces to visible portions of consumer products. For example, methods described herein can be used for providing protective and cosmetically appealing exterior portions of metal enclosures and casings for electronic devices, such as those manufactured by Apple Inc., based in Cupertino, Calif.

Figure 1A:
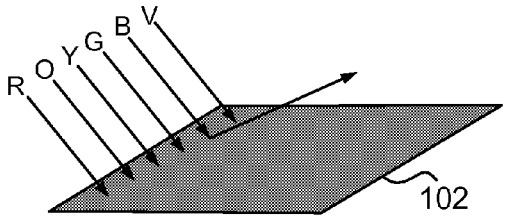
FIGS. 1A-1D illustrate different light absorption and reflection characteristics of objects having different optical properties.

In general, the visual appearance of objects relate to how the objects interact with incident light. FIGS. 1A-1D illustrate different light absorption and reflection characteristics of objects having different optical properties. FIG. 1A shows white light, which includes all wavelengths of the visible spectrum (red, orange, yellow, green, blue, and violet) in equal intensity, incident on blue object 102. Wavelengths corresponding to the colors red, orange, yellow, green, and violet are absorbed by object 102 while wavelengths corresponding to the color blue are reflected off object 102. Thus, object 102 appears blue. Similarly, objects that absorb wavelengths corresponding to the colors orange, yellow, green, blue, and violet while reflecting wavelengths corresponding to the color red will appear red. Thus, the color of an object will depend upon which wavelengths are absorbed and which wavelengths are reflected.

Figure 1B:
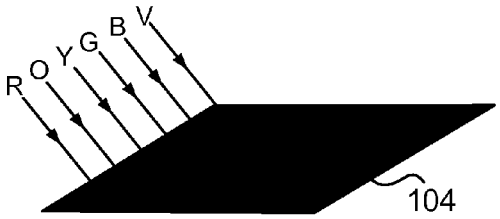
Figure 1C:
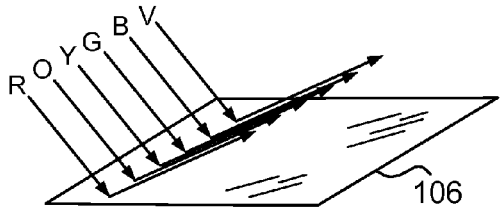
Figure 1D:
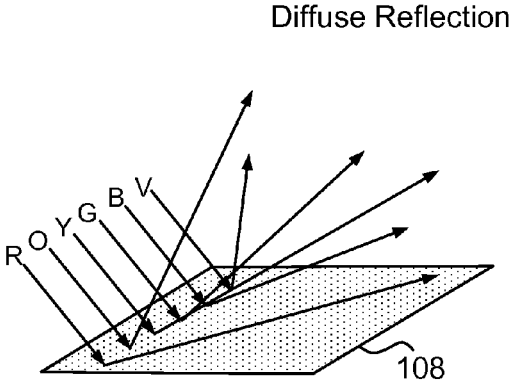

FIG. 1B shows object 104 that absorbs wavelengths corresponding to all colors red, orange, yellow, green, blue, and violet, giving object 104 a black appearance. FIG. 1C shows object 106 that reflects wavelengths corresponding to all colors red, orange, yellow, green, blue, and violet in a single direction. Such behavior is referred to as specular reflection and gives part 106 a mirror-like reflection or glossy appearance. FIG. 1D shows object 108 that has a textured or roughened surface. Incident light scatters in different directions, or diffuses, according to the surface profile of part 108, causing object 108 to appear matte. In general, the more light that is diffusely scattered, the less glossy the object will appear.

Figure 1E:
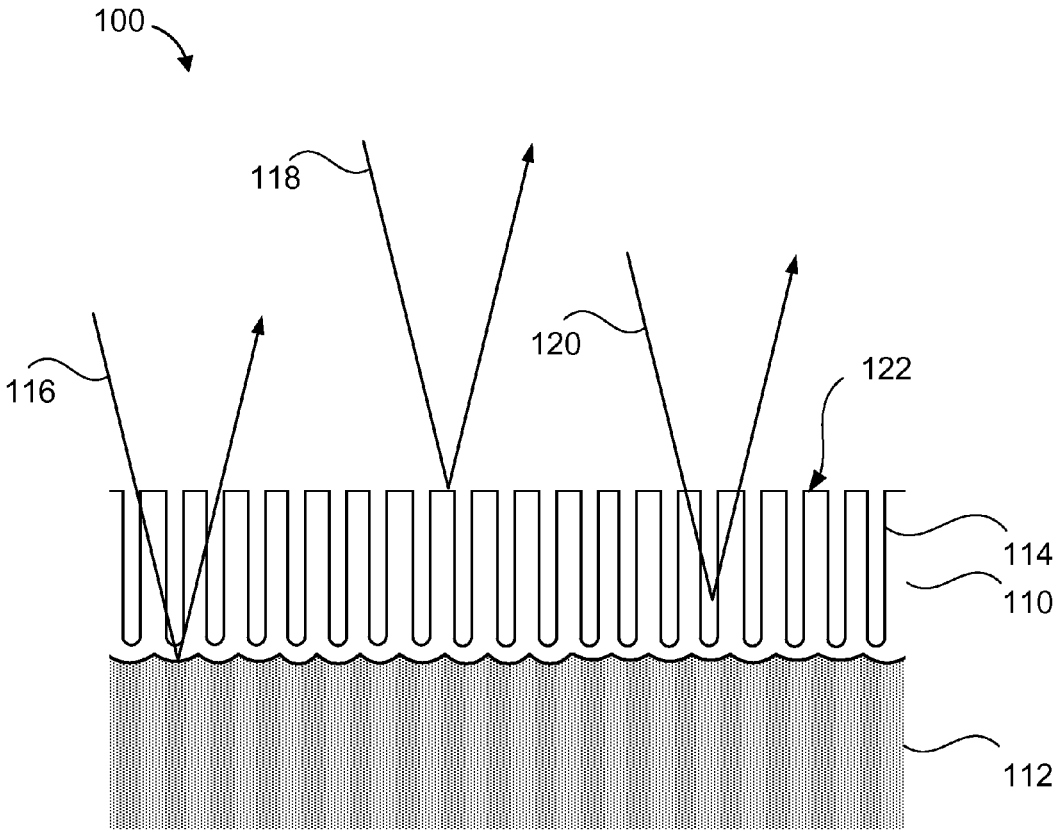
FIG. 1E shows a close-up cross-section view of a part with an anodic film illustrating light interaction with the anodic film.

Embodiments described herein involve forming or treating anodic films such that they absorb, specularly reflect, and/or diffusely scatter incident light, giving the anodic films particular optical characteristics such as particular colors, glossiness, and/or matte appearances. Anodic films are generally translucent in appearance in that most of the incident light is generally transmitted through the anodic films. FIG. 1E shows part 100 that has anodic film 110 disposed on substrate 112. Anodic film 110 is formed by converting a portion of substrate 112 to a film of metal oxide. The metal oxide film is referred to as an anodic film because of the process by which it is formed. Anodic film 110 has anodic pores 114, which form during the anodizing process. The majority of incident light, such as light ray 116, transmits through anodic film 110 and reflects off of the top surface of underlying substrate 112. This gives anodic film 112 a transparent quality. Some incident light reflects off of top surface 122 of anodic film, such as light ray 118. Some light transmits partially thought anodic film, such as light ray 120, before being reflected off of surfaces within anodic film 110, such as the pore walls of anodic pores 114. Light that reflects off of top surface 122 and surfaces within anodic film 112 adds an opaque quality to anodic film 110. The amount of transparency of anodic film 110 can depend in part on the thickness of film 110, with thicker films being less transparent. In some cases, anodic film can have an off-white or yellowish hue.

Figure 2A:
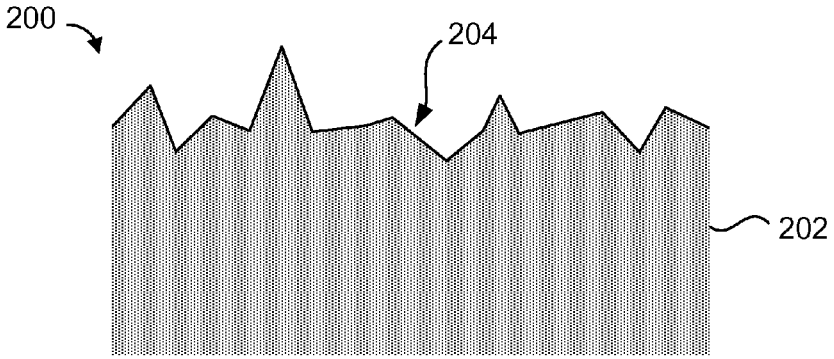
FIGS. 2A-2F show close-up cross-section views of a part undergoing a surface treatment process in accordance with some embodiments.
Figure 2B:
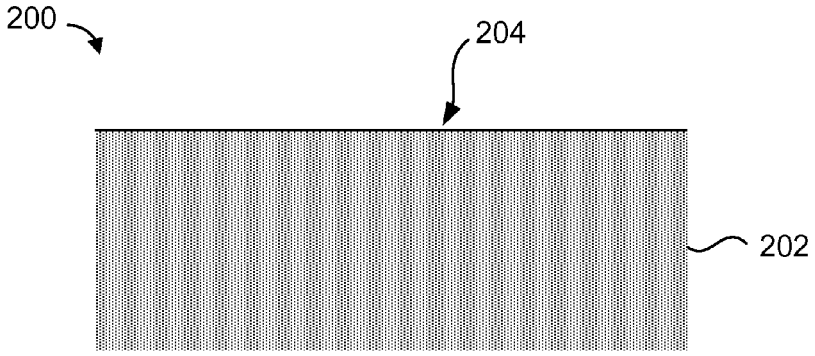

Methods described herein involve various procedures for forming anodic films having different colors and/or reflective qualities. FIGS. 2A-2F show close-up cross-section views of part 200 undergoing a surface treatment process in accordance with some embodiments. FIG. 2A shows metal substrate 202 having an unfinished rough surface 204. Suitable metal substrates 202 include any of aluminum, titanium, tantalum, magnesium, niobium, and stainless steel. Substrate 202 can be pure metal or a metal alloy. In some embodiments, part 200 can include non-metallic portions, such as plastic, ceramic, and/or glass portions. At FIG. 2B, surface 204 is polished such that surface 204 has a uniform and smooth topology. In some embodiments, one or more mechanical polishing procedures are used, such as abrading, buffing, and burnishing.

In some embodiments, after a mechanical polishing procedure, one or more additional surface finishing processes are performed to give surface 204 a particular appearance. In some embodiments, a chemical polishing procedure is performed. Chemical polishing generally involves applying a chemical polishing solution to surface 204. In some embodiments, the chemical polishing solution is an acidic solution, such as a solution containing phosphoric acid ($H_3PO_4$), nitric acid ($HNO_3$), sulfuric acid ($H_2SO_4$), or combinations thereof. During a chemical polishing procedure, the acidic solution further smoothes surface 204 so as to increase specular reflection and impart a glossy appearance to surface 204. The processing time of the chemical polishing procedure can be adjusted depending upon a desired target gloss value. In some embodiments, the chemical polishing parameters are chosen such that surface 204 has a melted or glass-like appearance.

In some embodiments after a mechanical polishing and/or a chemical polishing procedure, surface 204 undergoes a texturing process that increases the matte appearance and decreases the specular reflection of surface 204. The texturizing process can be accomplished via one or more mechanical processes such as by machining, brushing, or abrasive blasting or by chemical etching. In some embodiments, the textured surface enhances the richness or saturated appearance of a final color of surface 204 after subsequent anodizing and coloring processes. Some suitable texturing procedures are described in detail below with reference to FIGS. 4A-4C and 5A-5D.

Figure 2C:
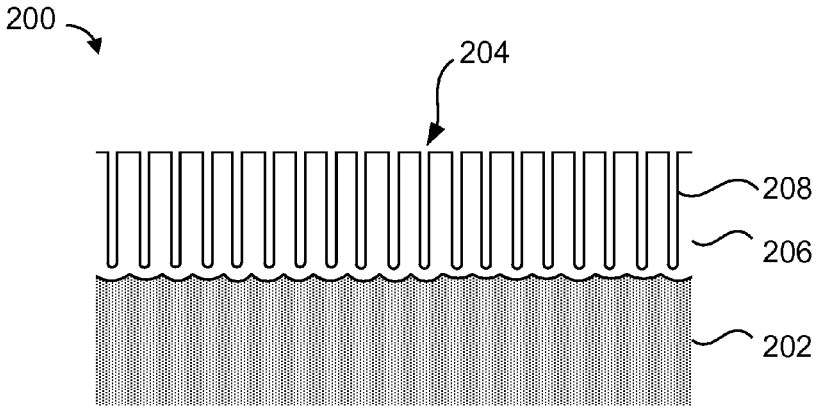

At FIG. 2C, part 200 is exposed to an anodizing process, whereby a portion of substrate 202 is converted to anodic film 206. Anodic film 206 includes a matrix of metal oxide material having numerous pores 208 formed therein. In some embodiments, anodic film 206 is at least partially transparent or translucent. In some embodiments, the final thickness of anodic film 206 ranges from about 7 to 30 micrometers. Note that since anodizing converts a portion of substrate 202, the finish given to surface 204 (e.g., highly polished or matte) is transferred to top surface 204 of anodic film 206.

Figure 2D:
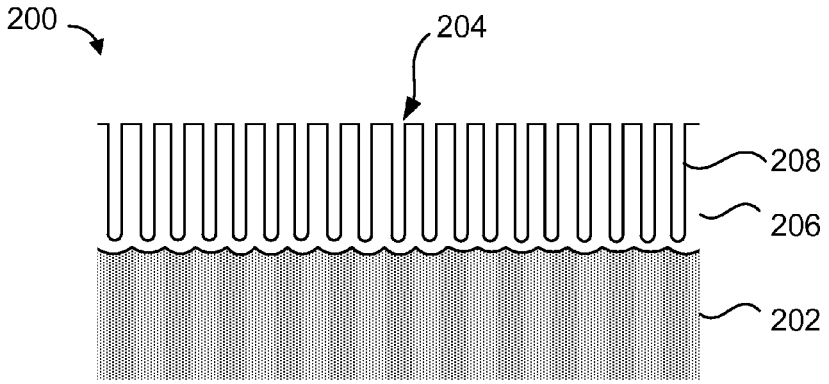

At FIG. 2D, the shapes of pores 208 within anodic film 206 are optionally modified. In some embodiments, pores 208 are widened to allow more metal and/or dye to be deposited in subsequent metal depositing and dyeing processes. The pore modifications can be made by, for example, dipping, immersing or spraying anodic film 206 in/with an acidic solution. In some cases, the acidic solution can be at temperatures above 25 degrees C. In some embodiments the acidic solution is in a steam state. In some embodiments, part 200 is immersed in an acidic electrolytic solution and a voltage is applied. In some embodiments, an electrolytic solution containing one or both or $H_2SO_4$ and $H_3PO_4$ and an alternating current (AC) is used.

Figure 2E:
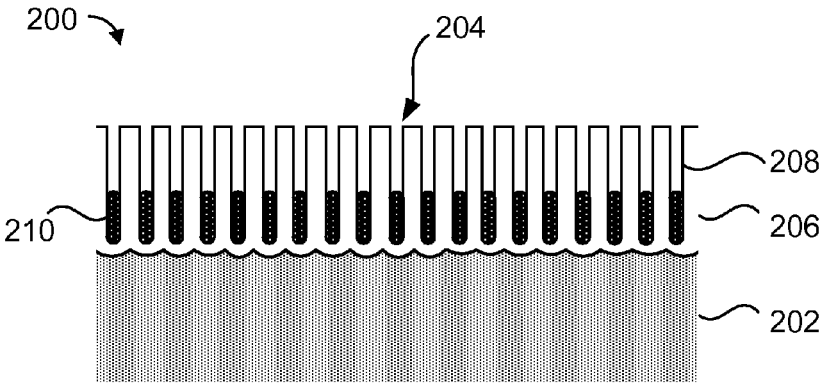

At FIG. 2E, metal material 210 is deposited within pores 208 of anodic film 206. Metal material 210 can be deposited using an electrodeposition process whereby part 200 is immersed in an electrolytic bath including a metal salt or a combination of two or more different metal salts. Any suitable metal salts can be used. In some embodiments, the metal salts include one or more of salts of nickel, tin, cobalt, and copper. When dissolved in solution, the metal salts form metal ions. During the electrodeposition process, part 200 acts as an electrode and when voltage is applied, the positively charged metal ions are attracted to and move toward top surface 207 of part 200. When the metal ions reach the bottom of pores 208 they deposit as metal material 210. The amount of metal material 210 can depend on process parameters such as the concentration of metal ions in solution, the applied voltages, and duration. Metal material 210 can change the optical properties of anodic film 206 in that anodic film will take on a color. That is, metal material 210 makes anodic film 206 absorb more visible wavelength of light compared to before metal deposition. In some embodiments, metal material 210 includes tin, imparting a dark brown to black color to anodic film 206. In some embodiments, metal material 210 includes a combination of tin and nickel, imparting a darker brownish black color to anodic film 206 compared to using only tin. In some embodiments, not only the type but also the amount of metal material 210 deposited within pores 208 affects the color of anodic film 206. In some embodiments, the metal deposition process includes a pre-dip process to provide a more uniform color to anodic film 206, which will be described in detail below with reference to FIGS. 6A-6C and 7.

Figure 2F:
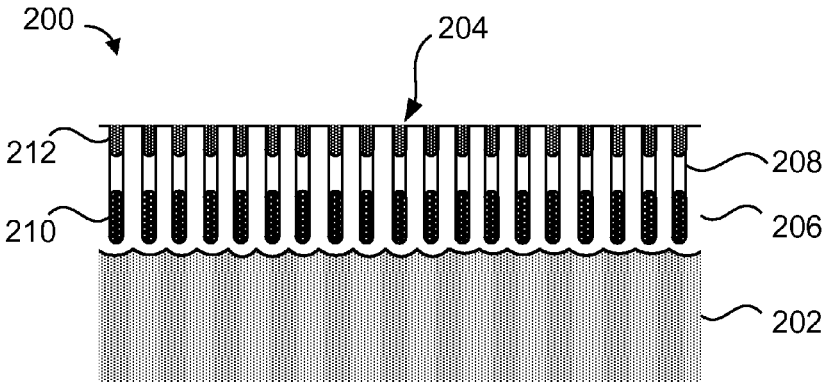

At FIG. 2F, dye 212 is deposited within pores 208 of anodic film 206. Dye 212 is deposited in at least the top portions of pores 208 near top surface 204. In some embodiments, dye 212 fills the remaining portion of pores 208 not occupied by metal material 210. Dye 212 can include any suitable dye compound and can be deposited using any suitable deposition process. The dyeing processes can include dipping or immersing the anodic film 206 or entire part 200 in a dye solution. In some embodiments, dye 212 includes an organic dye compound, inorganic dye compound, or a combination of both. Dye 212 can be chosen such that, when combined with metal material 210, will impart a predetermined color to anodic film 206. In some embodiments, dye 212 absorbs substantially the same range of visible wavelengths when deposited within pores 208 as metal material 210. In some embodiments, dye 212 absorbs a different range of visible wavelengths when deposited within pores 208 compared to metal material 210. In some cases, the dyeing process in conjunction with the metal depositing process can result in anodic film 206 having a deep and rich color. In one embodiment, metal material 210 contributes a dark brown color to anodic film 206 and dye 212 contributes a bluish color to anodic film 206, resulting in anodic film 206 having final a rich and deep black color. The final color of anodic film 206 can be measured using a spectrophotometer and the value can be compared against an established color standard to determine whether a desired color is achieved. In some embodiments, surface 204 is polished to increase the specular reflectiveness of surface 204 and imparting a glossy appearance to surface 204. A final gloss value of anodic film 206 can be measured using a glossmeter and compared against an established gloss standard to determine whether a desired amount of gloss (specular reflection) is achieved.

Figure 3:
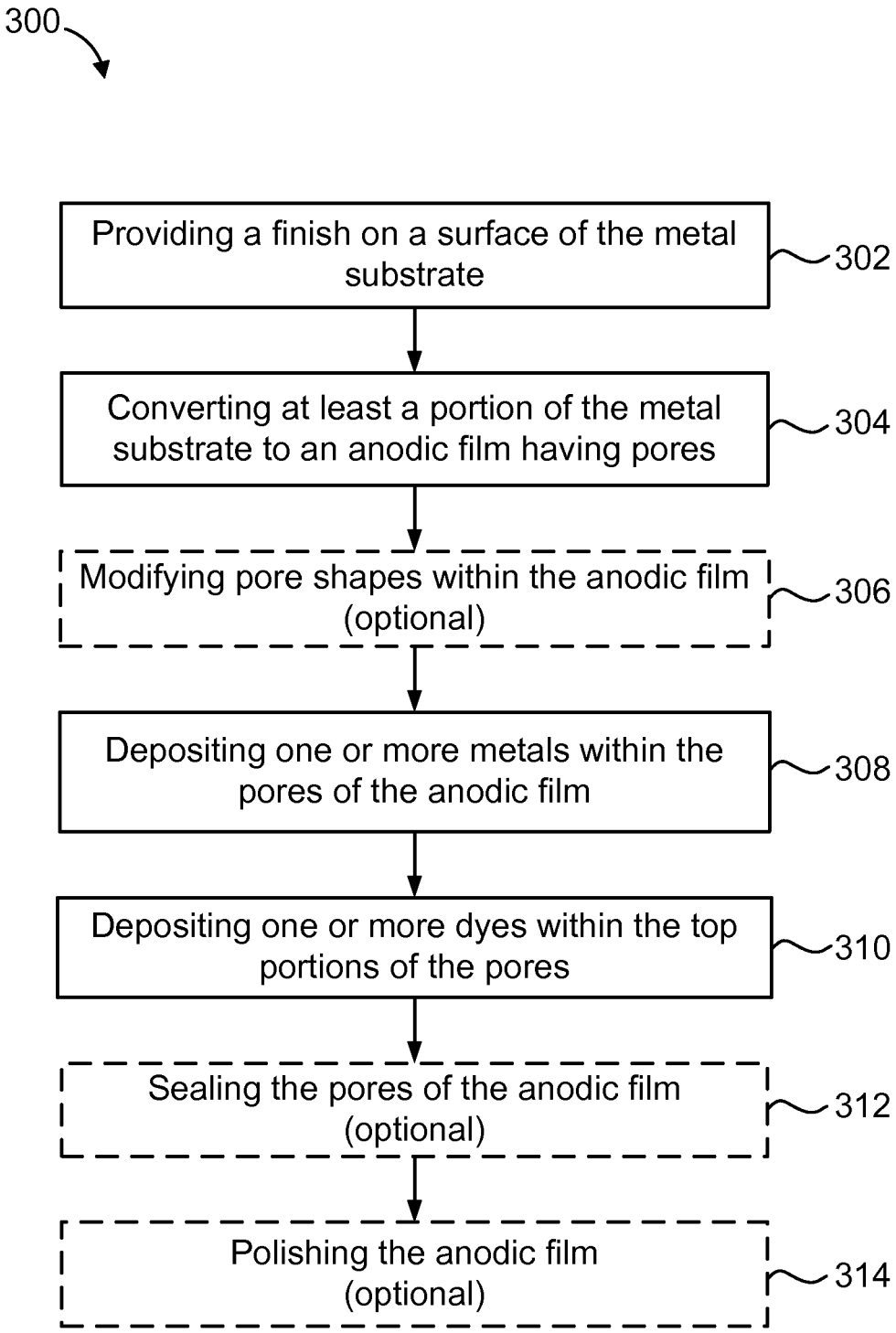
FIG. 3 shows a high-level flowchart of a surface treatment process in accordance with described embodiments.

FIG. 3 is a high-level flowchart 300 of a surface treatment process in accordance with FIGS. 2A-2F. At 302, a finish is provided on a surface of a metal substrate. In some embodiments, the surface is polished using a mechanical polishing process to from a uniform surface. In some embodiments, the uniform surface is further polished using a chemical polishing process that increases the specular reflection (gloss) of the substrate surface. In some embodiments, the uniform surface is textured using a texturing process that gives the substrate surface a matte appearance. Details regarding exemplary texturing processes are described below with reference to FIGS. 4A-4C and 5A-5D. At 304, at least a portion of the metal substrate is converted to an anodic film having anodic pores. Since the top surface of the metal substrate corresponds to the top surface of the anodic film, any surface finish given to metal substrate at 302 is transferred to the top surface of the anodic film. Thus, any gloss or matte appearance given to the substrate surface at 302 is remains at the anodic film surface.

At 306, the shapes of the pores within the anodic film are optionally modified. In some embodiments, the pores are widened so that more metal material and/or dye can be deposited within the pores in subsequent processes. At 308, one or more metals are deposited within at least the bottom portions of the pores of the anodic film. In some embodiments, an electrodeposition process is used. In some embodiments, one or both of tin and nickel are deposited within the bottom of the pores. The one or more metals can impart a first color to the anodic film. At 310, one or more dyes are deposited within at least the top portions of the pores. The one or more dyes can contribute a second color to the anodic film. In some embodiments, a black dyeing agent is used, such as Okuno Black 402, sold by Okuno Chemical Industries Co. Ltd. The final color of the anodic film will be a combination of the color contributions of the one or more metals and the one or more dyes deposited within the pores.

At 312, the pores of the anodic film are optionally sealed using a sealing process. The sealing process can include exposing the anodic film to a solution for a sufficient amount of time to create a sealant layer that seals the pores. In some embodiments, the sealing is performed using hot water or steam to convert a portion of the anodic film into its hydrated form. At 314, the anodic film is optionally polished to form a polished anodic film. In some embodiments, the anodic film is polished to have a smooth and glassy appearance. The polishing can include, for example, a buffing procedure or a combination of buffing procedures. The buffing process can be either manual or automated and can include using a work wheel having an abrasive surface. Polishing can also include a coarse buffing and/or a fine buffing. The order, sequence and number of buffing steps can be varied to produce a desired finish. In one embodiment, the polishing can include a tumbling process that can be following by one or more buffing processes. The polishing should be done in a manner such that the color imparted to the anodic film by the metal deposition and dyeing process are not substantially removed and such that the anodic film maintains a consistent and uniform color. Special care can be taken to assure edge portions of the anodic film do not become more polished. After the polishing complete, the anodic film can have a rich color with a shiny, glossy surface. In one embodiment, the resultant anodic film has a deep black color with a shiny, glossy appearance.

Figure 4A:
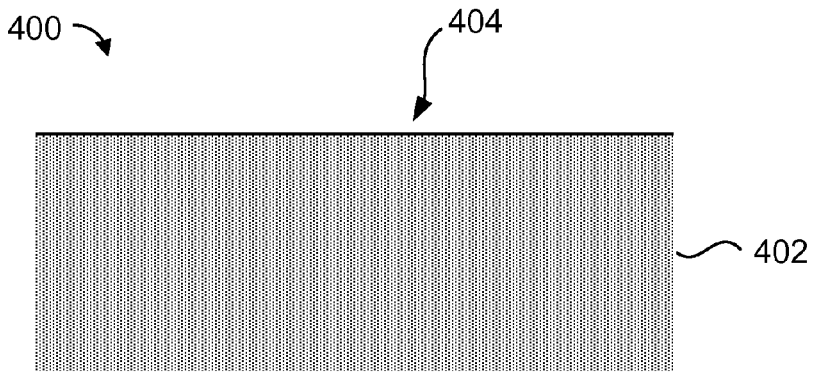
FIGS. 4A-4C show close-up cross-section views of a part undergoing a blasting treatment followed by chemical polishing treatment.
Figure 4B:
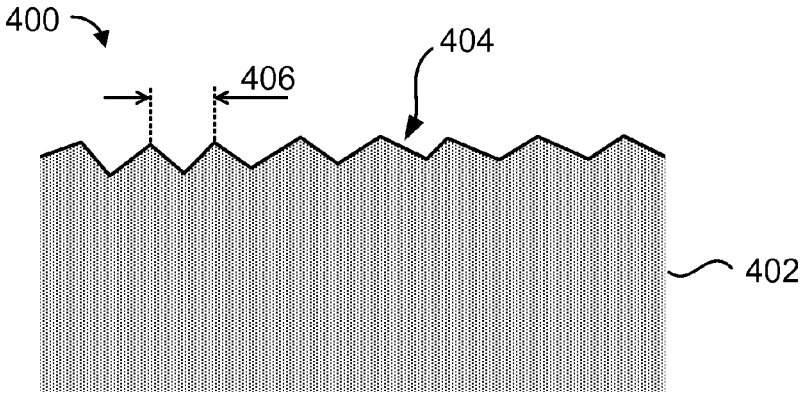
Figure 4C:
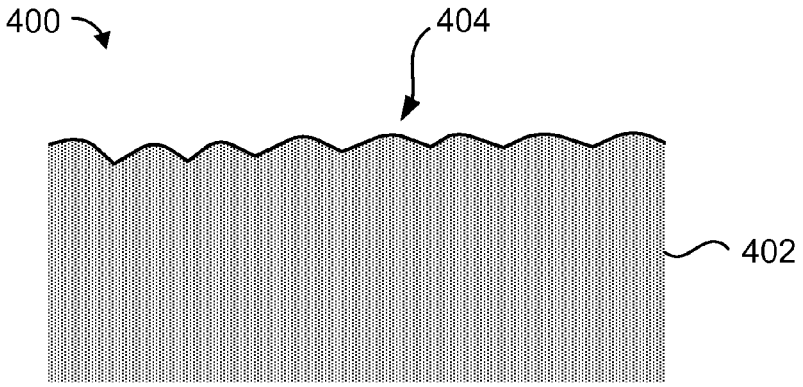

As described above, the metal substrate can be finished to have a texture prior to anodizing. FIGS. 4A-4C and 5A-5D show two different ways of forming two different textured surfaces in accordance with described embodiments. FIGS. 4A-4C show part 400 undergoing a texturing process and FIGS. 5A-5D show part 500 undergoing a different texturing process followed by anodizing, coloring and polishing processes. At FIG. 4A, surface 404 of substrate 402 of part 400 has undergone a polishing process to form a uniformly flat surface 404. In some embodiments, surface 404 is polished to a mirror-like shine. The polishing can include one or both of a mechanical and chemical polishing procedures.

At FIG. 4B, surface 404 has undergone a blasting process whereby a blasting media such as beads, sand, and/or glass are forcibly propelling a stream toward surface 404. The average pitch 406, which is the distance between adjacent peaks, typically ranges from about 100 micrometers to about 200 micrometers. The blasting process reduces the specular reflection off of surface 404 and gives surface 404 a matte appearance. In some cases, the blasting can be used to hide surface defects that exist on polished surface 404 at FIG. 4A. For example, polished surface 404 at FIG. 4A can have shiny spots that reflect light differently at certain angles compared to other portions of polished surface 404. At FIG. 4C, surface 404 is optionally exposed to a chemical polishing solution. The chemical polishing solution can be an acidic solution that has a sufficient acidity and is exposed to surface 404 a sufficient amount of time to round the peaks created by the blasting process. Other process parameters such as solution temperature can be adjusted to result in a desired amount of peak rounding. The peak rounding adds a specular reflective quality, or glossiness, to textured surface 404. Part 400 can then undergo one or more of the anodizing, metal depositing, and dyeing processes described above with reference to FIGS. 2A-2F and 3.

FIGS. 5A-5D show an alternative texturing process. At FIG. 5A, surface 504 of substrate 502 of part 500 has undergone a polishing process to form a uniformly flat surface 504. As with part 400 above, the polishing can include one or both of a mechanical and chemical polishing procedures and surface 504 can be polished to a mirror-like shine. At FIG. 5B, surface 504 has undergone a chemical etching process, whereby surface 504 is exposed to a chemical etching solution. In some embodiments, the chemical etch solution is an acidic solution. In some embodiments, the chemical etch solution contains one or more of malic acid, $HNO_3$, $H_3PO_4$, $H_2SO_4$, and HF. In some embodiments, the chemical etch solution contains a stabilizer such as Okuno Chemical OL-8 sold by Okuno Chemical Industries Co. Ltd. of Osaka, Japan. In some embodiments, surface 504 is exposed to the chemical etch solution at a temperature ranging from about 30 degrees C. to about 60 degrees C. for a time period ranging from about 1 minute to about 3 minutes. The chemical etch solution preferentially attacks or erodes the grain boundaries of surface 504 of metal substrate 502 faster than grain surfaces of surface 504. This preferential erosion at the grain boundaries creates a micro-textured surface having valleys at the grain boundaries and peaks positioned between the valleys. Thus, the peak-to-peak distance (pitch) 506 is on the order of the grain boundaries at surface 504, giving surface 504 a fine jagged topography or micro-textured appearance having substantially regular or uniform distances between peaks. The average pitch 506 will depend on the grain sizes of metal substrate 502 at surface 504. In some embodiments, average pitch 506 ranges from about 10 micrometers to about 50 micrometers. Because of the smaller pitch, micro-textured surface 504 has a different quality of matte appearance compared to blasted surface 404 described above. In some cases a chemical etch process can result in a textured surface having more consistent pitch compared to a textured surface formed from a blasting procedure.

Figure 5A:
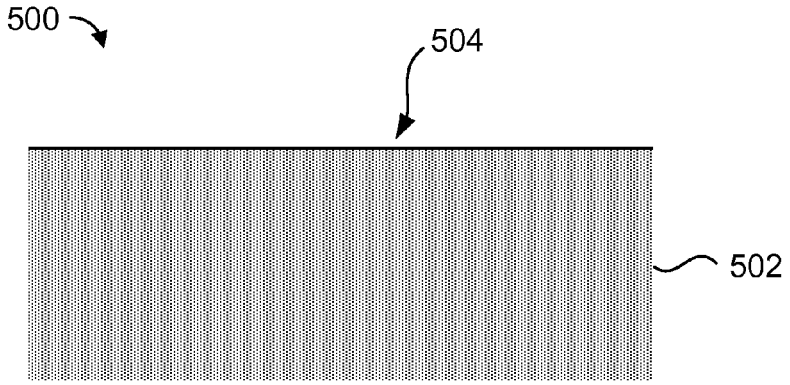
FIGS. 5A-5D close-up cross-section views of a part undergoing a chemical etching treatment followed by anodizing, coloring and optional polishing processes.
Figure 5B:
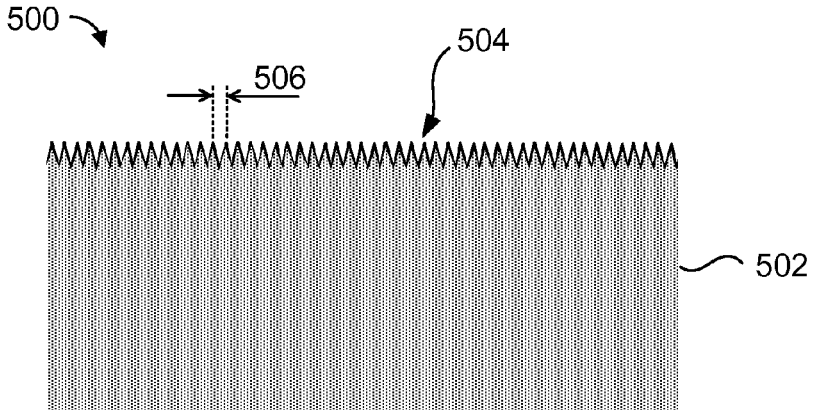
Figure 5C:
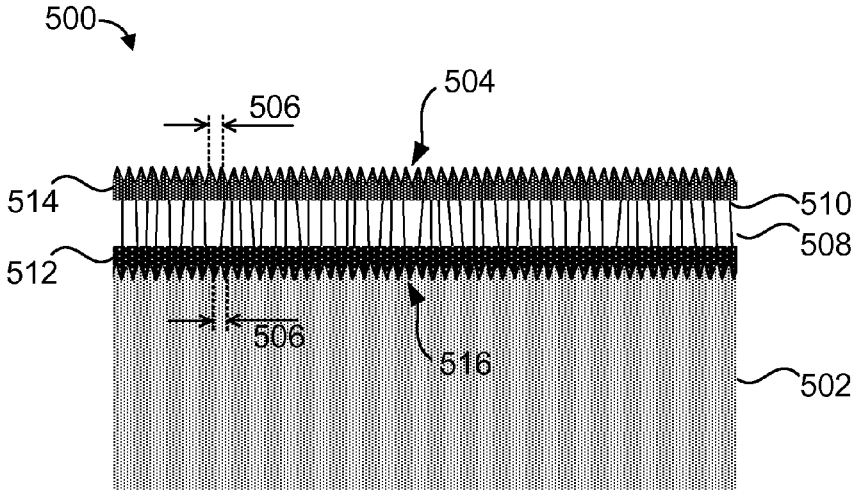

FIG. 5C shows part 500 after undergoing anodizing, metal depositing, and dyeing processes, similar to described above with reference to FIGS. 2A-2F and 3. As shown, a portion of substrate 502 is converted to anodic film 508 having a number of pores 510. Metal material 512 is deposited at the bottom portions of pores 510 and dye 514 is deposited at top portions of pores 510. As shown, anodic film 508 retains the micro-textured textured surface 504 of substrate 502 prior to anodizing and remains on top of part 500. In addition, a corresponding boundary surface 516 of underlying anodic film 508, between metal substrate 502 and anodic film 508, is formed during the anodizing process. Boundary surface 516 has a corresponding micro-textured surface 516 with average pitch 506 corresponding to average pitch 506 of anodic film top surface 506. In some embodiments, the micro-textured surface enhances the absorption characteristics of metal material 512 and/or dye 514 positioned within pores 510 of anodic film 508 compared to an anodic film with a textured surface having a larger average pitch or an un-textured surface. That is, the amount of visible light absorbed due to the presence of metal material 512 and/or dye 514 is associated with the average pitch 506 between the peaks of the micro-textured boundary surface 516. In some embodiments, the smaller the pitch, the greater the amount of absorbed visible light. Thus, the final color of anodic film 508 can be richer or more saturated compared to the color of an anodic film with a textured surface having a larger average pitch or an un-textured surface. In some embodiments, anodic film 508 can have a very dark and rich black color.

Figure 5D:
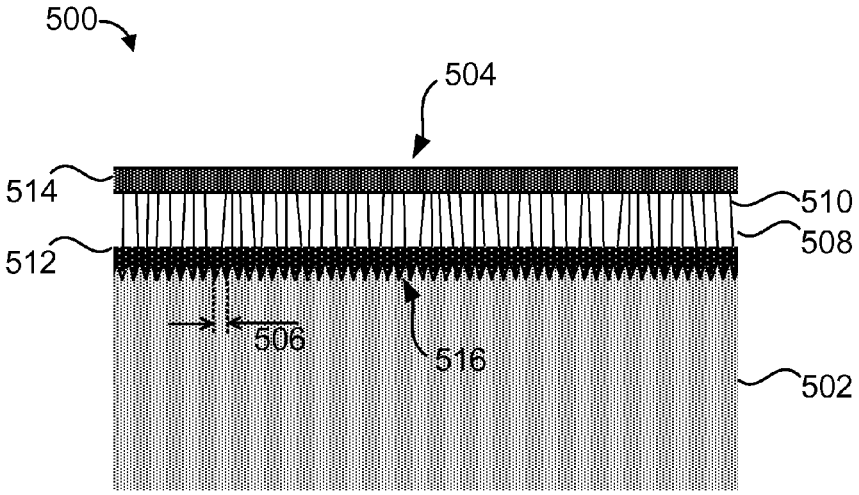

FIG. 5D shows part 500 after an optional polishing process, whereby top surface 504 of anodic film 508 is polished. The polishing can be accomplished through any suitable polishing methods, such as buffing or tumbling and can be performed manually or with machine assistance. Polishing anodic film 508 can smoothen at least part of the micro-textured texture of surface 504 and can add a specular reflective, or glossy, quality to anodic film 508. In some embodiments, surface 504 is polished until surface 504 has a glassy appearance, i.e. high specular reflection. Note that surface 516 of underlying substrate 502 retains the micro-textured surface texture and thus retains any color enhancement of metal material 512 provided by the micro-textured texture, as described above. Thus, part 500 can retain a rich saturated color and also have a shiny and glossy appearance.

In some embodiments, a richly colored lacquer appearance is achieved. Alternatively or in addition to the texturing processes described above with respect to FIGS. 4A-4C and 5A-5D, the surface can be texturized using an alkaline etching solution. In some embodiments, the alkaline etching solution includes a sodium hydroxide (NaOH) solution. In some embodiments, an ammonium bifluoride ($NH_4F_2$) solution is used.

Figure 6A:
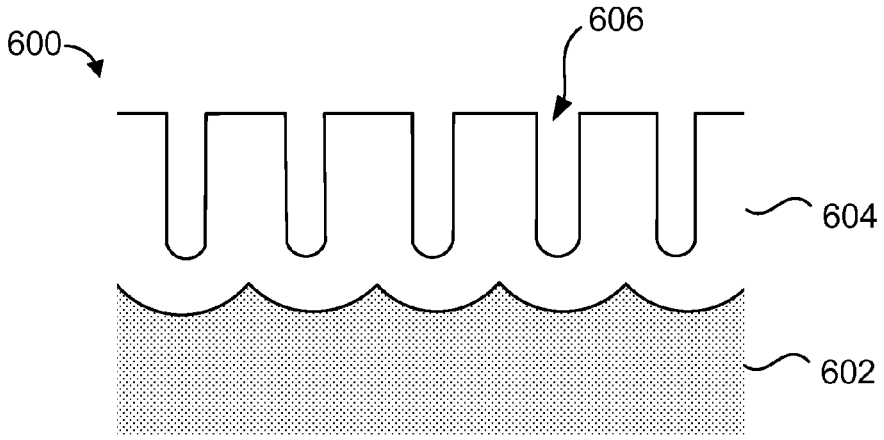
FIGS. 6A-6C show close-up cross-section views of a part undergoing a pre-dip and metal deposition process.
Figure 6B:
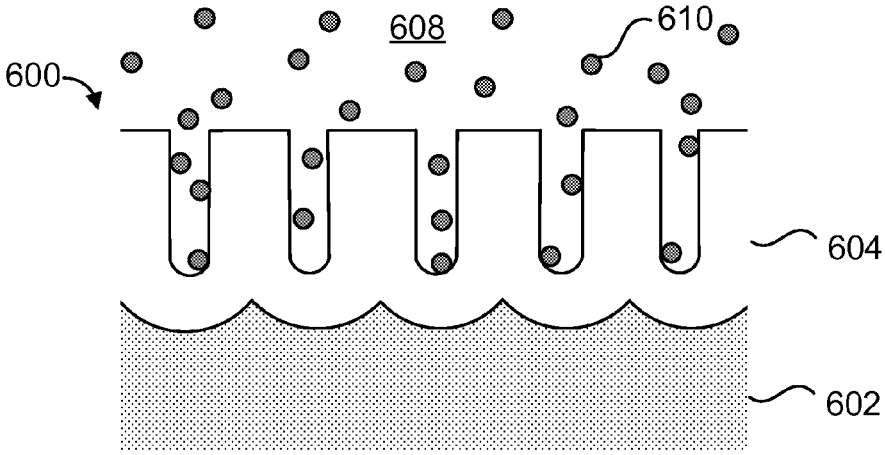
Figure 6C:
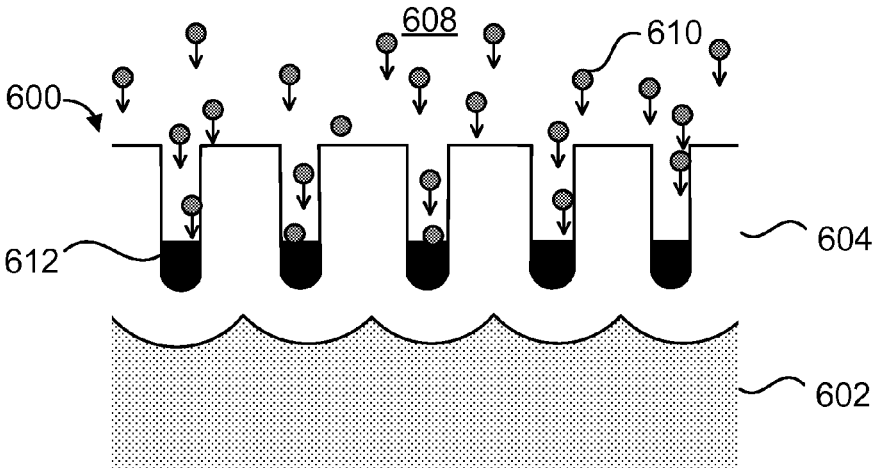

As described above with reference to FIG. 2E, in some embodiments a metal deposition process can include a pre-dip process prior to the metal deposition. FIGS. 6A-6C show close-up cross-section views of part 600 undergoing a pre-dip and metal deposition process. FIG. 6A shows part 600 after an anodizing process, whereby a portion of substrate 602 is converted to anodic film 604 having pores 606. FIG. 6B shows part 600 being immersed in electrolytic solution 608 in preparation for metal deposition. Electrolytic solution 608 contains metal ions 610. Before a voltage is applied, metal ions 610 are allowed to diffuse within pores 606. In some cases, metal ions 610 are allowed to uniformly diffuse among pores 606. This diffusive action procedure can be referred to as a pre-dip process. In some embodiments, the pre-dip process can take a time period of 5 minutes or more and can depend on factors such as electrolytic solution 608 temperature, metal ion 610 type, and other chemical components within electrolytic solution 608. In some embodiments, the pre-dip procedure is carried out for about 5 minutes to about 10 minutes. In some embodiments, the temperature of electrolytic solution is substantially the same as its temperature used during a subsequent metal deposition process.

FIG. 6C shows part during a metal deposition process, whereby a voltage is applied across part 600 and a corresponding electrode. Upon the applied voltage, positively charge metal ions 610 become attracted to part 600 and move toward the surface of anodic film 604. Metal ions 610, including metal ions 610 that are already within pores 606 due to the pre-dip procedure, move toward the bottom portions of pores 606 through electromotive force and become deposited as metal 612 within at least the bottom portions of pores 606. As described above, after the metal deposition process is complete, light incident a top surface of anodic film 604 can interact with metal 612 and the metal oxide material of anodic film 604 to impart a color to anodic film 604. By allowing metal ions 610 to diffuse into pores 606 during the pre-dip process prior to metal deposition, metal 612 can be more uniformly deposited among the number of pores 606 and the resultant anodic film 604 will have a more uniform color across anodic film 604.

Figure 7:
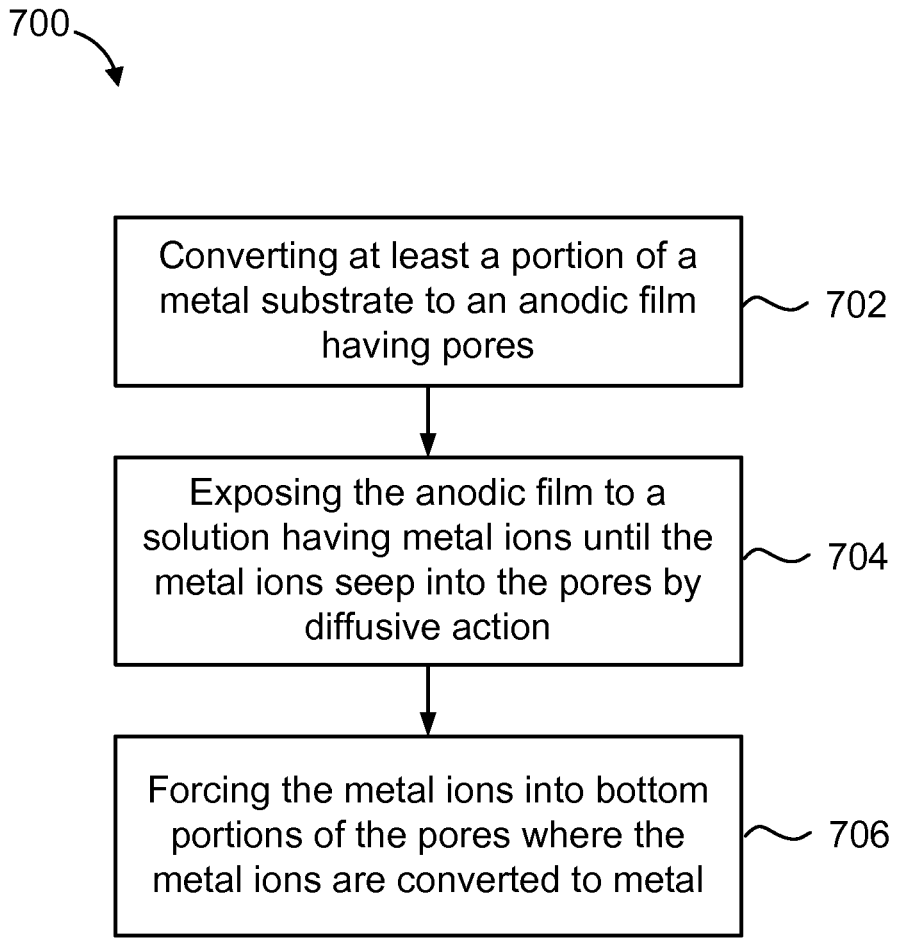
FIG. 7 shows a flowchart of the pre-dip and metal deposition process shown in FIGS. 6A-6C.

FIG. 7 shows flowchart 700 indicating a metal deposition process that includes a pre-dip process. At 702, at least a portion of a metal substrate is converted to an anodic film having pores. At 704, the anodic film is exposed to a solution having metal ions until the metal ions seep into the pores by diffusive action. At 706, the metal ions are forced ion toward the bottom portions of the pores where the metal ions are converted to metal material. The metal material can be deposited using an electrolytic deposition, whereby an electric field is applied to the solution. In some embodiments, the electrolytic solution contains one or both of $SnSO_4$ and $NiSO_4$. In some embodiments, an alternating current is used during the electrodeposition for a duration of between about 10 and 30 minutes. In some embodiments, the electrolytic solution is at a temperature of about 25 degrees C. or above. In some embodiments, the temperature ranges from about 25 degrees C. to about 35 degrees C. The metal material within the bottom portions of the pores imparts a color to the anodic film. Allowing the metal ions to diffuse within the pores prior to applying the electric field provides for a more uniformly colored anodic film.

Figure 8A:
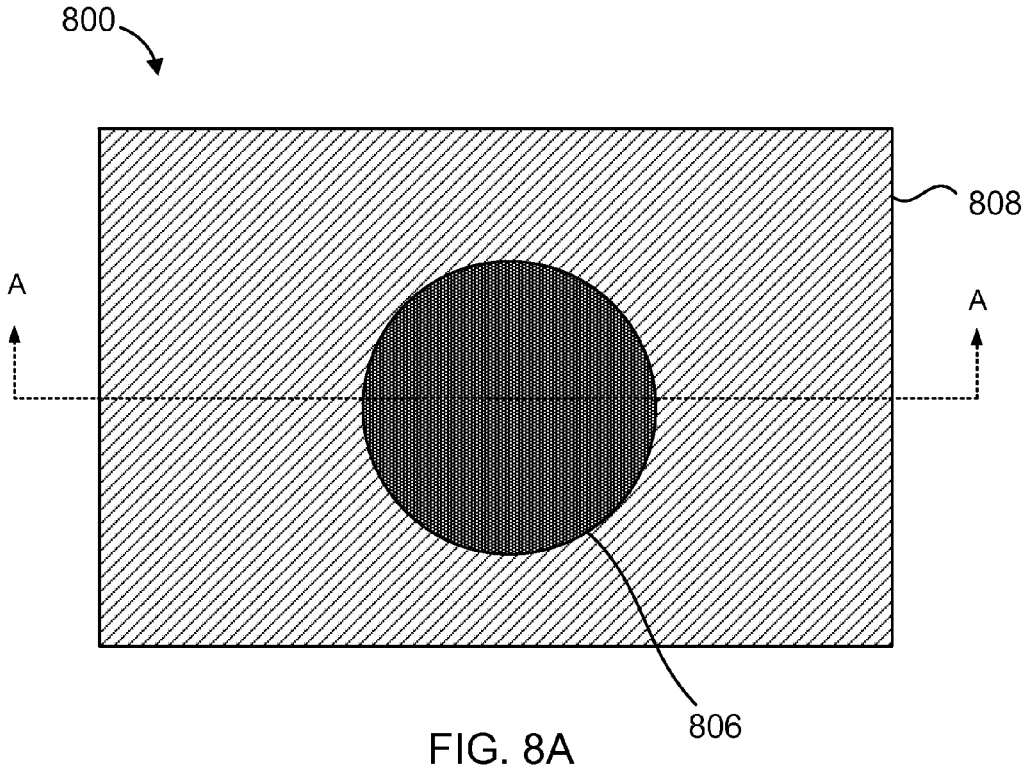
FIGS. 8A and 8B show top-down and cross section (A-A) views, respectively, of a metal part having undergone treatment processes in accordance with described embodiments.
Figure 8B:
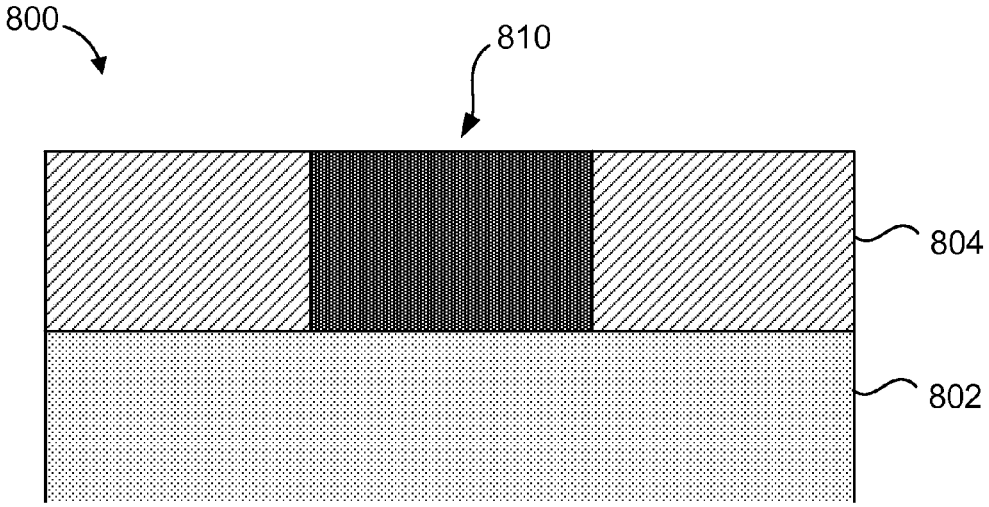

In some embodiments, different portions of a substrate can be treated to have a different optical appearance than other portions of the substrate in order to create different patterns and/or visual effects. Different patterns on the surface can include stripes, dots, logos, and text. FIGS. 8A and 8B show top-down and cross section (A-A) views, respectively, of metal part 800 having undergone treatment processes in accordance with described embodiments. Part 800 includes anodic film 804 disposed over metal substrate 802. Anodic film 804 includes first portion 806 and second portion 808. First portion 806 can have a different surface texture than second portion 808. For example, second portion 808 can have a blasted or micro-textured surface and first portion 806 can have a polished surface. First portion 806 can have a different color than second portion 808. For example, first portion 806 can appear black and second portion 808 can appear blue, green, red, etc., or be substantially translucent allowing underlying substrate 802 to be apparent from top surface 810. The different visual appearances of first 806 and second 808 portions can be obtained by masking portions of metal part 808 between certain processes. For example, a mask can be applied to first portion 806 while second portion 808 is left unmasked during one or more surface treatment or coloring procedures. The mask can then be removed and another mask applied to second portion 808 while first portion 806 undergoes a different treatment process.

It is noted that the procedures discussed above, for example the procedures indicated in FIGS. 2A-2F, 3, 4A-4C, 5A-5D, 6A-6C, 7, and 8A-8B are for illustrative purposes. Not every procedure need be performed and additional procedure can be included as would be apparent to one of ordinary skill in the art to create a surface having a desired optical effect. The procedures can be reordered as suitable and as desired.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

The invention claimed is:

1. A method of providing a coating on a surface of an aluminum alloy substrate, the method comprising:

applying a mask on a first section of the surface;

forming a micro-textured topology on a second section of the surface by exposing the surface to a chemical etching process that preferentially erodes grain boundaries, thereby forming peaks and valleys on the surface having an average pitch of between about 10 micrometers and about 50 micrometers between the peaks;

removing the mask to reveal the first section;

converting at least a portion of the aluminum alloy substrate to an anodic film having anodic pores such that a boundary surface between the aluminum alloy substrate and the anodic film takes on the micro-textured topology;

exposing the anodic film to a solution having metal ions dissolved therein for a time period of about 5 minutes or greater without applying an electric field to the solution;

applying the electric field to the solution thereby forcing the metal ions into bottoms of the anodic pores, wherein the metal ions are converted to a metal material that includes tin and nickel; and depositing a dye within the anodic pores, wherein the metal material and the dye within the anodic film impart a black color to the anodic film, wherein exposing the anodic film to the solution without applying the electric field is associated with a uniformity of the black color across the anodic film, wherein the micro-textured topology enhances a light absorption characteristic of the metal material positioned at the bottoms of the anodic pores such that the second section has a more saturated black color than the first section.

2. The method of claim 1, wherein the chemical etching process involves exposing the aluminum alloy substrate to an acidic etching solution.

3. The method of claim 1, wherein the dye is deposited by immersing the anodic film in a dye solution.

4. The method of claim 1, wherein the chemical etching process involves exposing the aluminum alloy substrate to an alkaline etching solution.

5. The method of claim 1, further comprising polishing the anodic film.

6. The method of claim 5, wherein the polishing results in the anodic film having a consistent final color.

7. The method of claim 1, wherein the dye contributes a blue hue to the anodic film.

8. The method of claim 1, wherein the metal material absorbs a first range of wavelengths of visible light and the dye absorbs a second range of wavelengths of visible light.

9. The method of claim 1, wherein the first section has a shape of a stripe, dot, logo, or text.

10. The method of claim 1, wherein a thickness of the anodic film ranges from about 7 to 30 micrometers.

11. A method of providing a coating on a surface of an aluminum alloy substrate, the method comprising:

applying a mask on a first section of the surface;

forming a micro-textured topology on a second section of the aluminum alloy substrate by eroding grain boundaries at the surface of the aluminum alloy substrate using chemical etching, wherein the micro-textured topology includes peaks and valleys, the peaks having an average pitch between about 10 micrometers and about 50 micrometers;

removing the mask to reveal the first section;

converting a portion of the aluminum alloy substrate to an anodic film comprising anodic pores with pore bottoms proximate to a boundary surface between the aluminum alloy substrate and the anodic film, the boundary surface taking on the micro-textured topology;

exposing the anodic film to a solution comprising metal ions for five minutes or greater without applying an electric field;

applying the electric field to the solution thereby forcing the metal ions to deposit as metal material within the pore bottoms of the anodic pores, the metal material including tin and nickel; and depositing a dye within the anodic pores, wherein the metal material and the dye within the anodic film impart a black color to the anodic film, wherein exposing the anodic film to the solution without applying the electric field is associated with a uniformity of the black color across the anodic film, wherein the micro-textured topology enhances a light absorption characteristic of the metal material positioned at the pore bottoms such that the second section has a more saturated black color than the first section.

12. The method of claim 11, wherein depositing the dye includes immersing the anodic film in a dye solution.

13. The method of claim 11, further comprising polishing the anodic film.

14. The method of claim 11, wherein the dye contributes a blue hue to the anodic film.

15. A method of treating a surface of an aluminum alloy substrate comprising:

applying a mask on a first section of the surface;

forming a micro-textured topology on a second section of the aluminum alloy substrate by exposing the aluminum alloy substrate to a chemical etching process, wherein the chemical etching process forms peaks within the aluminum alloy substrate having an average pitch ranging from about 10 micrometers to about 50 micrometers;

removing the mask to reveal the first section;

converting a portion of the aluminum alloy substrate to an anodic film having anodic pores, the anodic film having a boundary surface the comprises the micro-textured topology;

performing a pre-dip process on the anodic film by exposing the anodic film to a solution comprising metal ions for at least five minutes without applying an electric field to the solution;

applying the electric field to the solution thereby forcing the metal ions to deposit as a metal material within the anodic pores, the metal material including tin and nickel that absorbs a first range of wavelengths of visible light, wherein the micro-textured topology enhances a light absorption characteristic of the metal material; and depositing a dye within the anodic pores, wherein the dye absorbs a second range of wavelengths of visible light, resulting in the anodic film having a black color, wherein exposing the anodic film to the solution prior to applying the electric field is associated with a uniformity of the black color, wherein the micro-textured topology enhances a light absorption characteristic of the metal material positioned at the bottoms of the anodic pores such that the second section has a more saturated black color than the first section.

16. The method of claim 15, wherein depositing the dye includes immersing the anodic film in a dye solution.

17. The method of claim 16, wherein the dye contributes a blue hue to the anodic film.

18. The method of claim 15, further comprising polishing the anodic film.

19. The method of claim 15, wherein the dye contributes a blue hue to the anodic film.

* * * * *